US006677807B1

(12) United States Patent
Brokaw

(10) Patent No.: US 6,677,807 B1
(45) Date of Patent: Jan. 13, 2004

(54) CURRENT MIRROR REPLICA BIASING SYSTEM

(75) Inventor: Adrian Paul Brokaw, Burlington, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/703,862

(22) Filed: Nov. 1, 2000

Related U.S. Application Data

(60) Provisional application No. 60/163,586, filed on Nov. 5, 1999.

(51) Int. Cl.[7] ..... G05F 1/10
(52) U.S. Cl. ..... 327/538; 323/316
(58) Field of Search ..... 327/530, 538–541; 323/315–317

(56) References Cited

U.S. PATENT DOCUMENTS 4,507,573 A * 3/1985 Nagano ..... 327/334
5,027,004 A * 6/1991 Palara ..... 327/68
5,187,429 A * 2/1993 Phillips ..... 323/315
5,451,859 A * 9/1995 Ryat ..... 323/315
5,640,110 A * 6/1997 Niratsuka et al. ..... 327/108
6,407,620 B1 6/2002 Hirayama ..... 327/538

* cited by examiner

*Primary Examiner*—Kenneth B. Wells
(74) *Attorney, Agent, or Firm*—Iandiorio & Teska

(57) ABSTRACT

A current mirror replica biasing system where the resistor-programmable base current of a current reference transistor is accurately and scalably mirrored and input to the base of an output transistor, the current provided by the output transistor being useful as bias current to a load circuit, including a current reference transistor and an output transistor of like polarity; a pair of bipolar transistors, of like polarity to each other and opposite polarity to the current reference transistor and output transistor, arranged as a current mirror to mirror the base current of the current reference transistor, which base is exclusively interconnected to the input of the current mirror; and a current source to establish a desired reference current in the current reference transistor; wherein variations in the current source circuitry can result in circuit performance of the current mirror replica biasing system that is proportional to absolute temperature, or other desired function.

12 Claims, 9 Drawing Sheets

CURRENT MIRROR REPLICA BIASING SYSTEM

RELATED APPLICATIONS

This application claims benefit of U.S. Provisional Application No. 60/163,586 filed on Nov. 5, 1999.

FIELD OF INVENTION

This invention relates to a current mirror replica system and more particularly to such a system which combines the function of a current mirror and that of a replica biasing circuit in one system.

BACKGROUND OF INVENTION

It is sometimes necessary to provide a circuit or system with a bias current. Replica biasing is a technique for providing such current by creating a desired reference current flow in a reference current circuit, and then creating a replica of that reference current to make the required bias current, and supplying that replica bias current to the load circuit. When the desired bias current is large, it may be desirable to have the replicated current be a multiple of the reference current. This would be the case, for example, when total current drain on the system is a concern, so that a small reference current in the reference current circuit would economize current use.

The replica current may be created by a current mirror. Current mirror circuits, in their various forms, have certain shortcomings, but still manage to work well in some applications. Conventional current mirror circuits, however, encounter significant drawbacks when the replicated current is a multiple of the reference current. In such circuits, the effects of base currents flowing between the transistors carrying the replica current and the transistors creating the reference current become non-negligible, and significant deviations in the replica current can arise.

SUMMARY OF INVENTION

What is needed is a current mirror replica biasing system in which the reference current circuit may operate at a fraction of the current of the active circuit, and in which the required bias current is created using a current mirror which dependably provides a multiple of the reference current in the reference current circuit. Another desirable feature of such a current mirror replica biasing system in some applications would be to have its output be proportional to absolute temperature, or other desired function.

It is therefore an object of this invention to provide a simpler, more accurate combined current mirror replica biasing system.

It is a further object of this invention to provide such a current mirror replica biasing system which is capable of high ratio current mirroring.

It is a further object of this invention to provide such a current mirror replica biasing system that combines the functions of both a current mirror and replica biasing circuit in a single, more efficient design.

It is a further object of this invention to provide a current mirror replica biasing system which has the ability to drive a load with an output that is substantially proportional to absolute temperature.

The invention results from the realization that a truly simpler and more accurate replica biasing system which is accurate even at large current ratios can be effected by de-coupling the reference current side of the circuit from the effects of the output side of the circuit; in particular, by incorporating the current reference transistor into the current mirror circuit so that the base current of the current reference transistor becomes the exclusive input mirrored by the current mirror and delivered to the base of the output transistor to produce an operating current in the output transistor which is in the same proportion to the operating current in the current reference transistor as the desired current ratio, be it unity or greater or lesser than unity. The only exception to this exclusivity is the addition of currents proportional to the base current.

This invention features a reference current circuit in which is established a reference current, which current has a known and fixed ratio to the desired bias current output. The sample base current of a transistor in the reference current circuit is connected exclusively to the input of a current mirror circuit, which replicates the base current in the reference current circuit. An output buffer circuit buffers the output of the current mirror and transmits the replicated current to an output transistor to control the operation of the output transistor. This circuit can also deliver a replicated current to an additional circuit for further processing prior to delivering that current to the output transistor or other load. Each transistor has a first and second current terminal and a control terminal.

In a preferred embodiment, the reference current circuit may be as simple as a transistor of opposite polarity to the current mirror transistors, and a resistor. The reference current circuit may further include one or more other transistors and resistors to increase the quantity of the reference current, or to render the output of this invention proportional to absolute temperature, or some other desired function. The current mirror circuit may include two transistors with interconnected control terminals, and one transistor may be a scaled-up version of the other. The output buffer circuit may consist of a transistor of like polarity to the current mirror transistors and opposite polarity to the reference current transistor, and of like size to the output transistor of the two current mirror transistors. The current reference transistor and output transistor are ratio matched; that is the output transistor is of like polarity and functional characteristics of the reference current transistor, but of like size to the output buffer transistor.

This invention also features a current mirror replica biasing system including a current mirror circuit having a controlling transistor and a controlled transistor with their emitters connected to like polarity voltages and operating at a predetermined current ratio. There is an output buffering transistor of like polarity to the controlling and controlled transistors. The output buffering transistor has one of its load terminals connected to the controlled transistor and the bases of the controlling transistor and controlled transistor. There is also a current reference transistor and an output transistor both of opposite polarity to the controlling, controlled and output buffering transistors. The current reference transistor has its collector connected to a voltage of like polarity to the voltage connected to the emitters of the controlling and controlled transistors and its base connected to the collector of the controlling transistor. The base of the output transistor is connected to the collector of the output buffering transistor and the collector of the output transistor is connected to the circuit to be biased. There is a current source for generating a desired current having the first terminal and the second terminal with the second of the terminals connected to a common voltage closer to ground than the voltage is connected to the emitters of the controlling and controlled transistors and the collector of the current reference transistor. The first of the terminals is interconnected to the emitter of the current reference transistor and the base of the output buffering transistor. In a preferred embodiment, the controlled and controlling transistors may have equal current densities in the areas of their emitters and may be in a predetermined current ratio. The controlled and controlling transistors may have their emitters connected to voltages of like polarity but of different magnitude, the difference in voltage defining the ratio of the predetermined current ratios. The transistors may be bipolar transistors. The controlled, controlling and output buffering transistors may be PNPs and the current reference and output transistors may be NPNs. The transistors may be bipolar transistors with the controlled, controlling and output buffering transistors being NPNs and the current reference and output transistors being PNPs. The current source may be a resistor. The current source may include a first resistor having a first terminal and a second terminal. There may be a sixth transistor of like polarity to the current reference transistor, a second resistor and a third resistor where the collector of the sixth transistor is interconnected to the emitter of the current reference transistor and the base of the output buffering transistor and the emitter of the sixth transistor is connected to the first terminal of the first resistor. The second terminal of the first resistor may be connected to the common voltage and the second resistor and third resistor may be connected as a voltage divider between the common voltage and the voltage of like polarity to that of the controlling and controlled transistors. The base of the sixth transistor may be interconnected with the center of the voltage divider.

The invention also features a current mirror replica biasing system including a current mirror circuit having a controlling transistor and a controlled transistor with their emitters connected to like polarity voltages and operating in a predetermined current ratio. There is an output buffering transistor of like polarity to the controlling and controlled transistors. The output buffering output transistor has one of its load terminals connected to the collector of the controlled transistor. There is first resistor having a first and second terminal, a second resistor having a first and second terminal, and a third resistor having a first and second terminal. The current reference transistor of opposite polarity to the controlling, controlled and output buffering transistors has its collector connected to a voltage of like polarity to that of the controlling and controlled transistors and its base connected to the collector of the controlling transistor. There is an output transistor of like polarity to the current reference transistor. The emitter of output transistor is connected to a voltage less than the voltages connected to the controlling, controlled and current reference transistors and the collector of the output transistor is connected to the circuit to be biased. There is a sixth transistor of like polarity to the current reference transistor. The collector of the sixth transistor is interconnected to the emitter of the current reference transistor and the base of the output buffering transistor. The emitter of the sixth transistor is connected to the first terminal of the first resistor and the second terminal of the first resistor is connected to a voltage less than the voltages connected to the controlling, controlled and current reference transistors. There is a seventh transistor of like polarity to the current reference transistor. The emitter of the seventh transistor is connected to the base of the sixth transistor. The collector of the seventh transistor is interconnected to the base of the current reference transistor and the collector of the controlling transistor. The second and third resistors are connected as a voltage divider between a voltage of like polarity to that of the controlling and controlled transistors and a voltage less than such voltages. The base of the seventh transistor is interconnected with an intermediate terminal of the voltage divider.

The invention also features a method of creating a bias current including establishing in a reference transistor a reference current of known magnitude; using a current mirror to mirror exclusively the base current of the reference transistor; and feeding the mirrored current into the base of an output transistor.

DISCLOSURE OF PREFERRED EMBODIMENT

Other objects, features and advantages will occur to those skilled in the art from the following description of a preferred embodiment and the accompanying drawings, in which.

Figure 4:
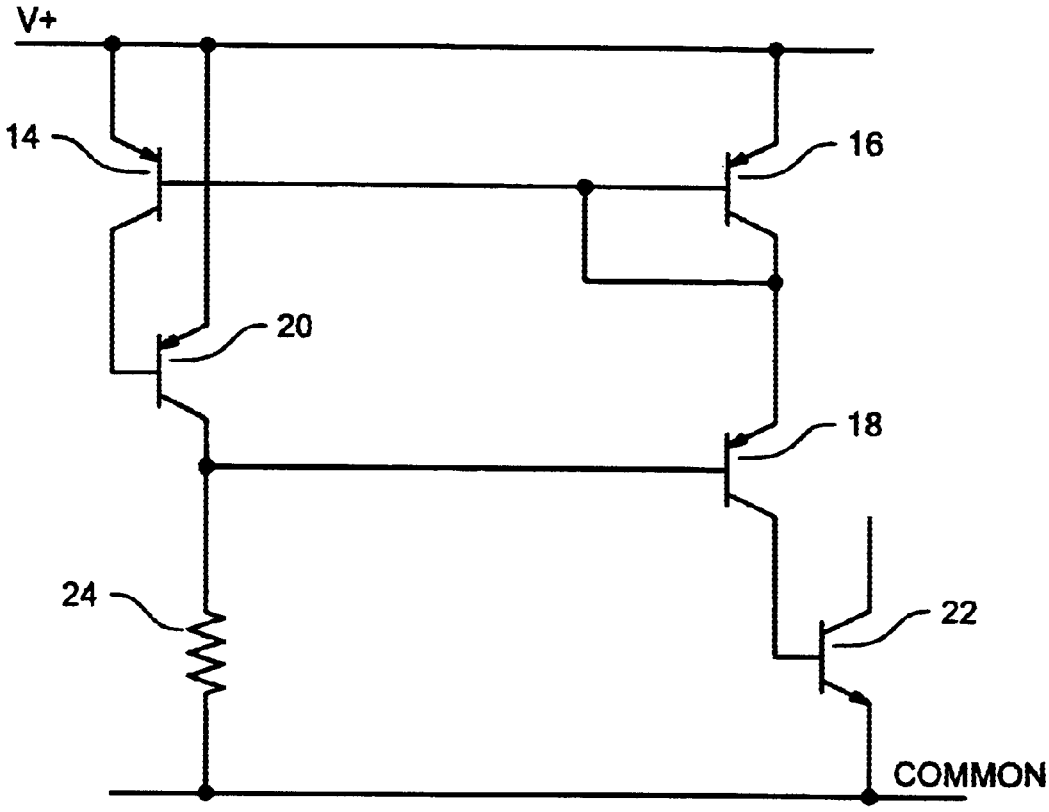
FIG. 4 is a schematic diagram of a current mirror replica bias system according to the present invention.
Figure 7:
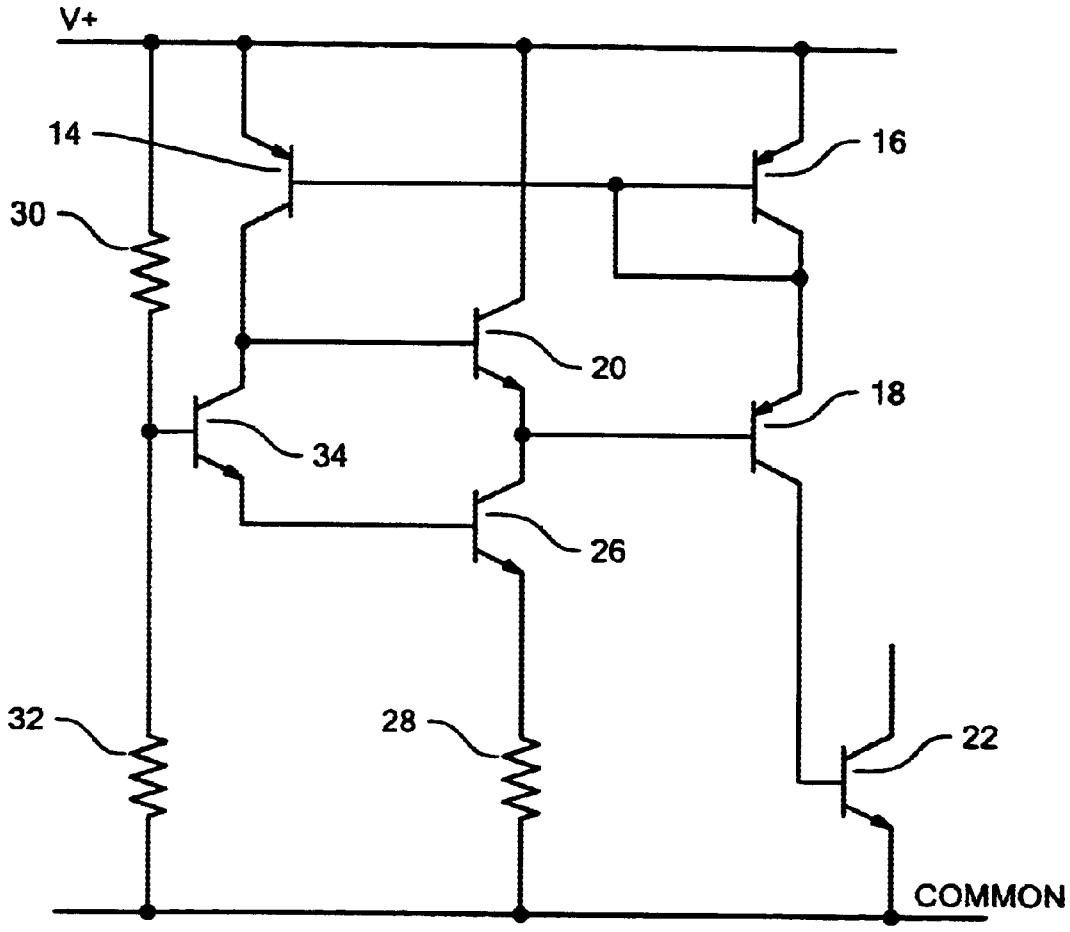
Figure 8:
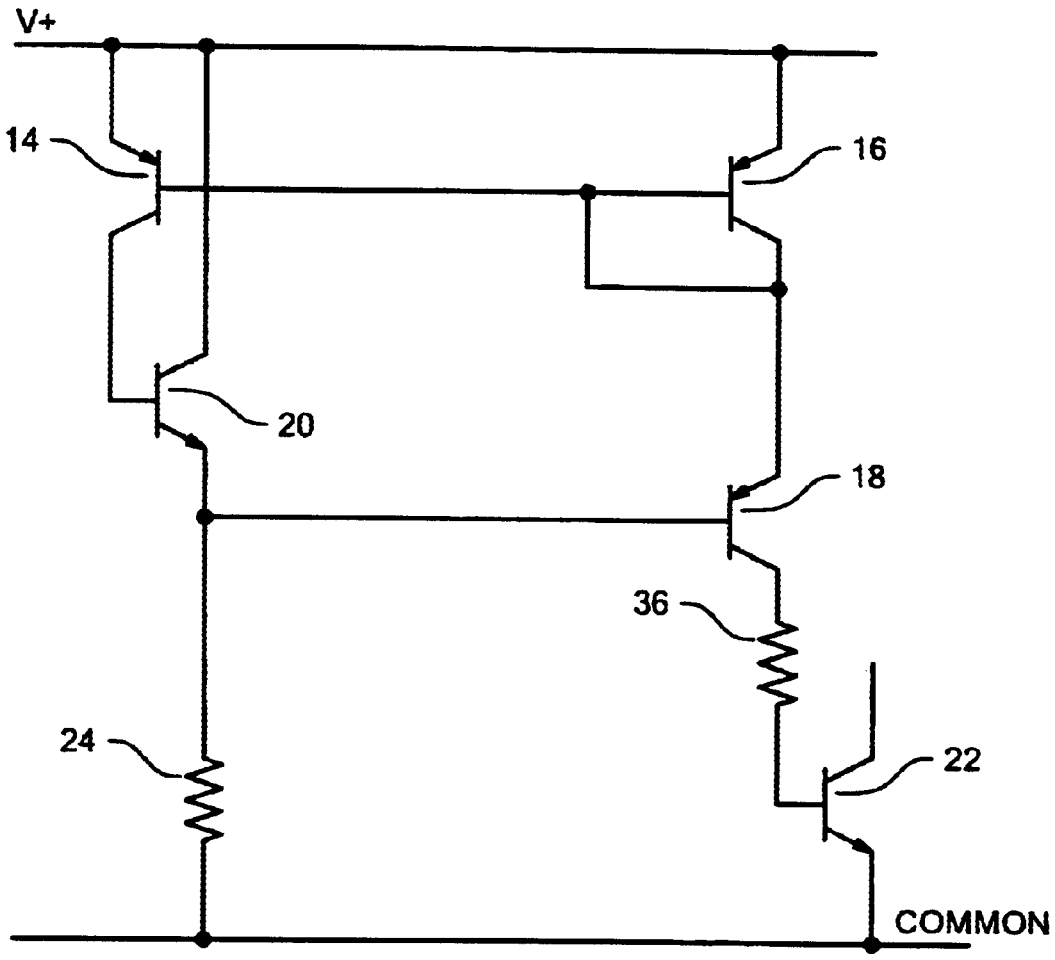
Figure 9:
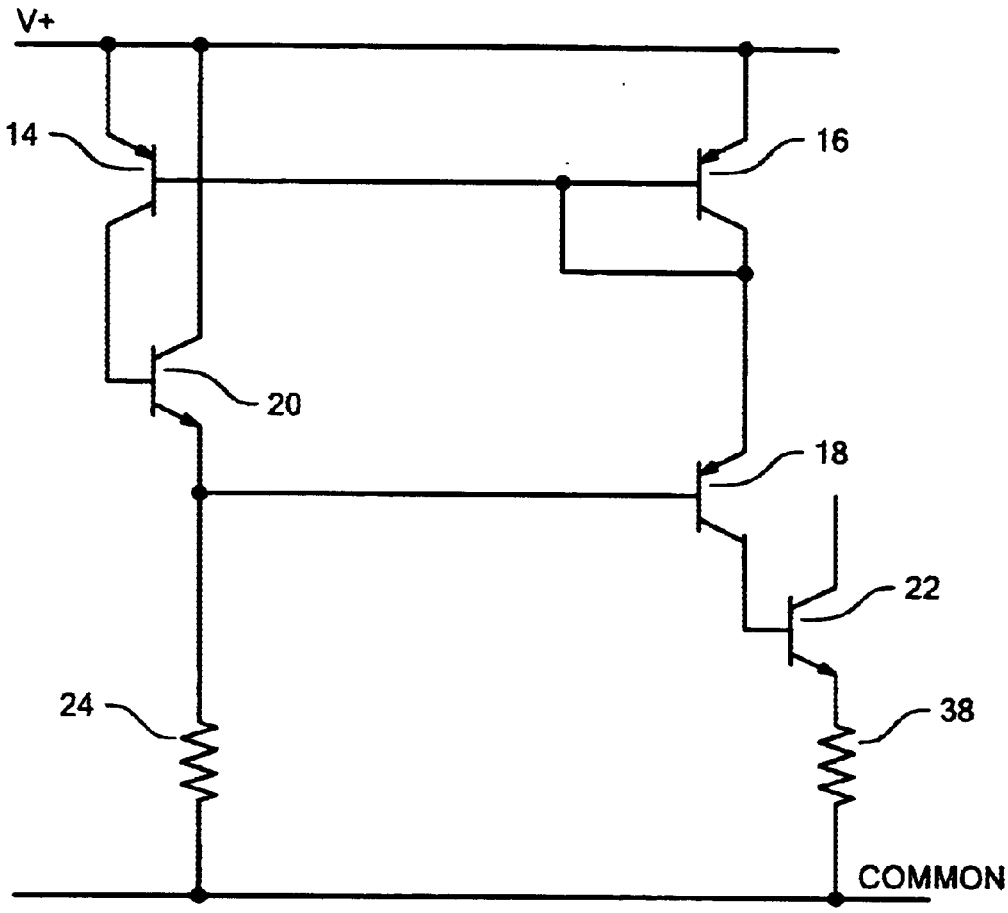

FIG. 7 is a schematic diagram of another alternate and improved embodiment of a current mirror replica bias system according to the present invention similar to the system shown in FIG. 4, showing additional circuitry to efficiently and economically increase the gain of the current replication and to make it proportional to absolute temperature; and FIG. 8 and FIG. 9 are schematic diagrams of current mirror replica bias circuits substantially similar to FIG. 4, but using additional resistors around the output transistor, as might be the case in varying applications of the present invention.

Figure 1:
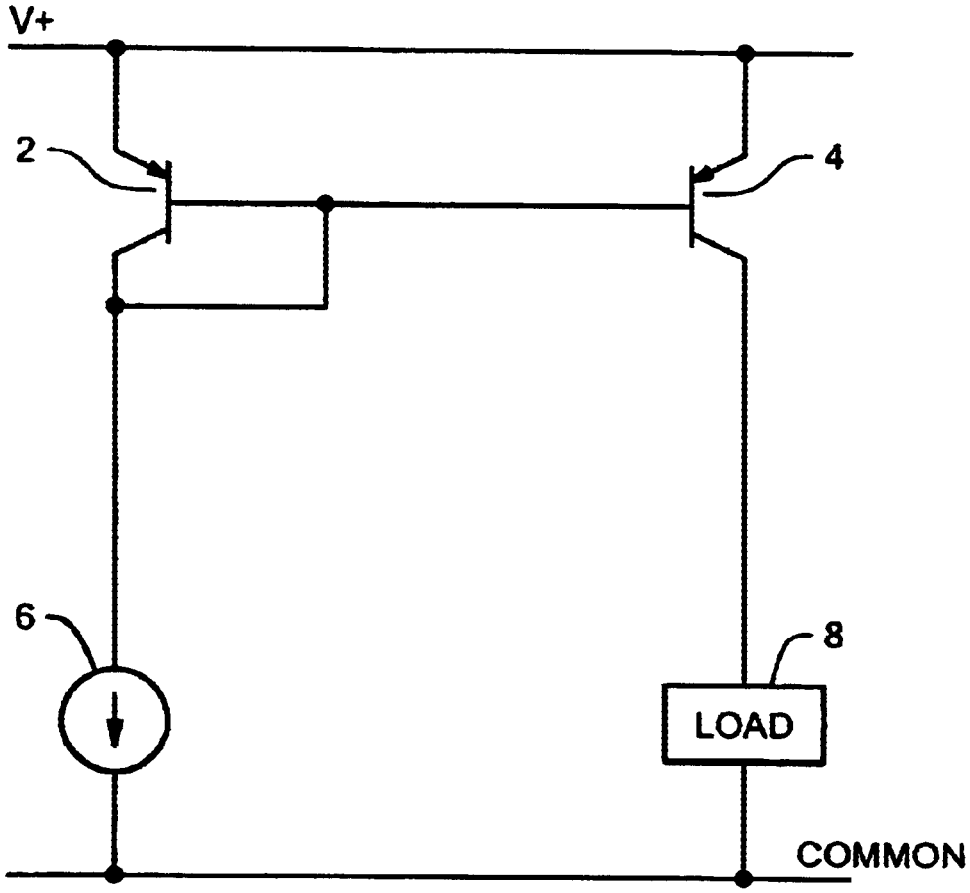
FIG. 1 PRIOR ART
FIG. 1 is a schematic diagram of a prior art simple current mirror.

There is shown in FIG. 1 a simple prior art current mirror which includes first and second bipolar transistors 2 and 4 of similar, e.g. PNP, polarity. The emitters of both transistors 2 and 4 are connected to a positive voltage supply. The bases of both transistors 2 and 4 are interconnected with the collector of transistor 2 and to current source 6; in operation, the collector of transistor 4 is connected to a load circuit 8.

In operation, transistors 2 and 4 behave substantially similarly, since both are subject to similar conditions. In particular, the emitter currents of both transistors 2 and 4 will be approximately identical. The collector currents of transistors 2 and 4 will also be approximately identical. However, the currents flowing through the current source 6 and load circuit 8, respectively, will differ by the sum of the base current of transistor 2 and the base current of transistor 4, since both such base currents are supplied by the current source 6 and reduce the collector current in transistor 4. Thus, the collector current of transistor 4 is an inexact replica of the current supplied by the current source 6.

Specifically, assuming the transistors are of the same size, because the base current of transistors 2 and 4 are supplied by the reference current, the replica current in the collector of transistor 4 differs from the current supplied by the current source 6 by an amount equal to two base currents. Nevertheless, it can be seen that the replica current is a function of the current in the current source 6, and the replica current can be controlled, subject to the aforementioned errors, by controlling the current in the current source 6.

If transistor 4 is a larger scale replica of transistor 2, the collector current in transistor 4 will be proportionately larger than the collector current in transistor 2, but the associated error will be likewise exaggerated. Although not shown in any figure, a desired current ratio may also be achieved by connecting the emitters of transistors 2 and 4, respectively, to differing voltages.

While transistors 2 and 4 are shown as PNP transistors, this is not a necessary limitation of the invention, as NPN transistors may be used throughout with suitable modifications known to those skilled in the art.

Figure 2:
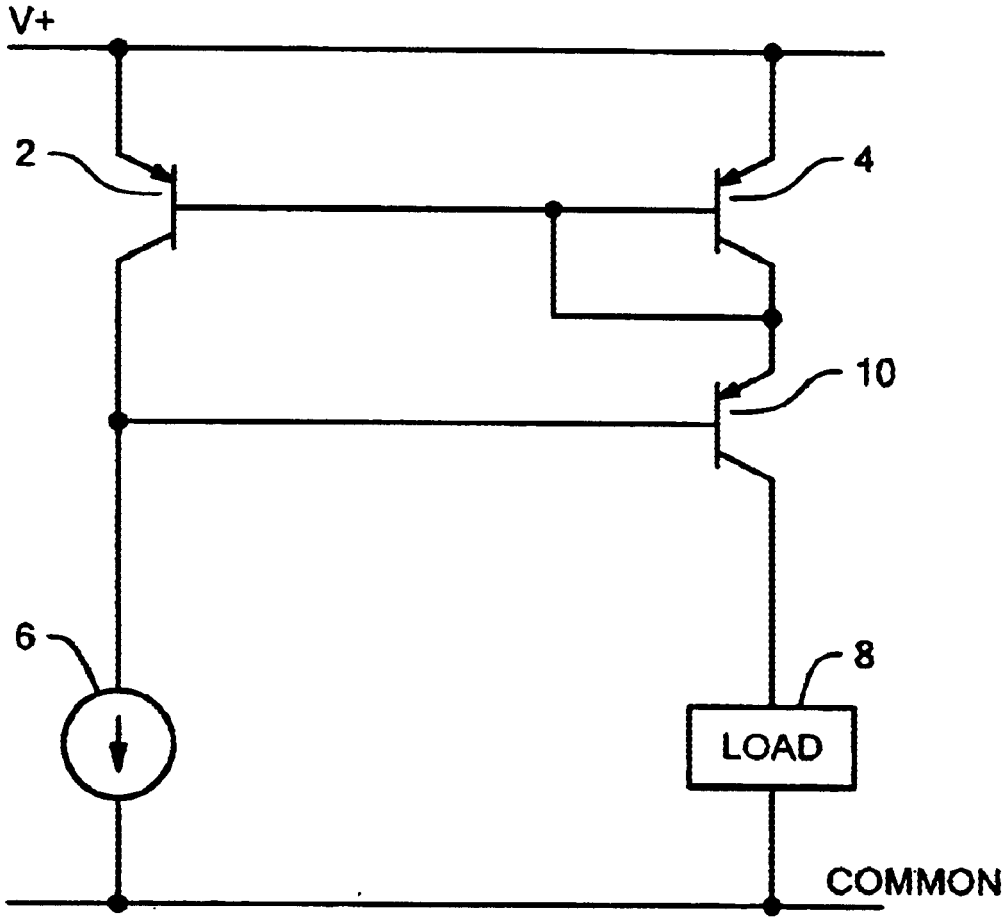
FIG. 2 PRIOR ART
FIG. 2 is a schematic diagram of an improved prior art simple current mirror, commonly known as a Wilson current mirror.

There is shown in FIG. 2 a prior art Wilson current mirror, which adds a third transistor 10 of like polarity to transistors 2 and 4, and in which the bases of transistors 2 and 4 are interconnected with the collector of transistor 4 and the emitter of transistor 10. The base of transistor 10 is interconnected with the collector of transistor 2 and current source 6.

Similar to the simple current mirror of FIG. 1, the emitter current in transistor 2 is substantially the same as the current provided by the current source, and is mirrored by the emitter current in transistor 4. The collector current of transistor 4, however, is augmented by the base currents of transistors 2 and 4, and is therefore not an exact replica of the reference current in the emitter of transistor 2. The addition of the transistor 10, however, results in the subtraction of the base current of transistor 10 from the replica current, such that the base current errors inherent in the simple current mirror are almost entirely canceled.

Therefore, if all three transistors in FIG. 2 are identical, the collector current in transistor 10 is a good replica of the emitter current of transistor 2, and of the current in the current source. If transistors 4 and 10 are scaled up to provide a multiple of the reference current, however, the base current in transistor 10 will be proportionately larger than the base current in transistor 2, and the current cancellation properties of the Wilson current mirror are lost.

Figure 3:
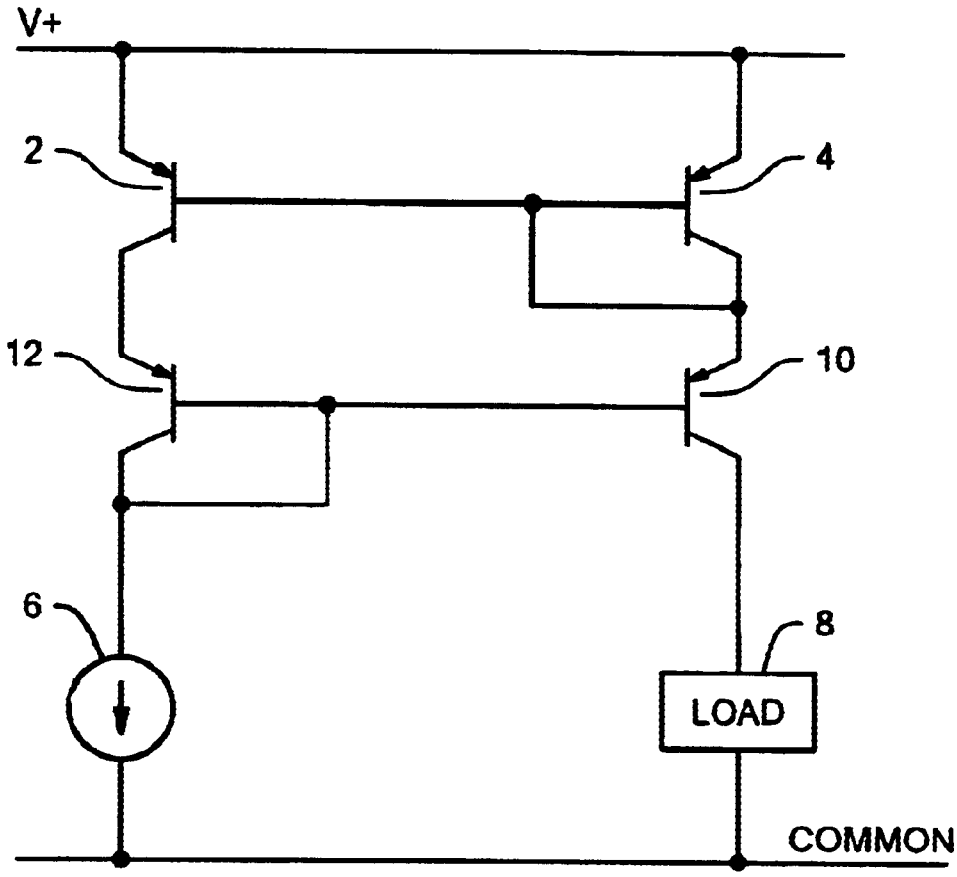
FIG. 3 PRIOR ART
FIG. 3 is a schematic diagram of an improved prior art Wilson current mirror.

FIG. 3 shows an improved prior art Wilson current mirror, in which a fourth transistor 12 has been added. In FIG. 2, the collector of transistor 2 is two base-emitter drops from the supply, while the collector of transistor 4 is only a single base-emitter drop from the supply. This causes a small error in the mirroring of current from transistor 2 to transistor 4. The addition of the fourth transistor 12 in the circuit of FIG. 3 does not change the foregoing analysis of current flow within the circuit of FIG. 2, but matches up the collector voltages of transistors 2 and 4 to further improve the replica accuracy.

There is shown in FIG. 4 a current mirror replica biasing system according to this invention which includes current mirroring transistors 14 and 16, a third transistor 18 of like polarity to transistors 14 and 16, a fourth transistor 20 and fifth transistor 22 of opposite polarity to transistors 14, 16 and 18, and a resistor 24. Transistor 20 and transistor 22 are matched to each other such that they will exhibit substantially similar responses to any given set of stimuli, although transistor 22 may be a scaled-up version of transistor 20. In practice, transistor 22 will be part of the signal path of the circuit being biased by the present invention.

The emitters of transistors 14 and 16, and the collector of transistor 20, are connected to the positive voltage supply. The bases of transistors 14 and 16 are interconnected to the collector of transistor 16 and the emitter of transistor 18. The collector of transistor 14 which is the input to the current mirror is exclusively connected to the base of transistor 20. The emitter of transistor 20 is interconnected to the base of transistor 18 and resistor 24. The collector of transistor 18 is connected to the base of transistor 22. The emitter of transistor 22 and the other terminal of resistor 24 are connected to the common voltage supply.

In operation, the emitter current in transistor 20 for any given power supply voltage is determined by the selection of the value of resistor 24; as such, resistor 24 effectively replaces the current source 6 shown in FIG. 1, FIG. 2, and FIG. 3. Establishing an emitter current in transistor 20 will necessarily establish a base current in transistor 20, and because they are exclusively interconnected, the base current in transistor 20 is the same as the collector current in transistor 14. Assuming that the transistors are of equal size and neglecting the effects of the base currents in transistors 14, 16 and 18, it can be seen that the collector current in transistor 14 is, in turn, the same as the emitter current in transistor 14, and likewise, is the same as the emitter and collector currents in transistor 16, and the emitter and collector currents in transistor 18. Thus, the collector current in transistor 18 is the same as the collector current in transistor 14. Accordingly, the base current of transistor 22 is a replica of the base current of transistor 14. Since the base current of transistor 14 is a function of the reference current flowing through transistor 20, it will be seen that the output current in the collector of transistor 22 is a replica of the reference current, which in turn is a function of the user-selected value of resistor 24. The collector of transistor 22 is the output of the current mirror replica biasing system, and in operation will be connected to the load circuit.

The key to understanding this invention is that the replica current in the circuit of FIG. 4 is not a direct function of the current in the current source, as in FIG. 1, FIG. 2 and FIG. 3, but rather a function of the base current in transistor 20, with the result that the reference side of the circuit has been de-coupled from the output side of the circuit. In each of FIG. 1, FIG. 2 and FIG. 3, the side of the circuit that creates the reference current is influenced by the input base current from a transistor on the output side of the circuit. The addition of such current into the reference side of the circuit used-up some of the current in the current source 6 of the circuit, resulting in an error in the replicated current. As previously discussed, the Wilson current mirror of FIG. 2 and the improved Wilson current mirror of FIG. 3 were attempts to mitigate this problem, but did not eliminate the problem.

In contrast, the present invention eliminates the problem by effectively de-coupling the reference side of the circuit from the output side of the circuit. To accomplish this effect, it is important that the reference transistor be incorporated into the current mirror. Specifically, the base of the reference transistor must be exclusively connected to the input of the current mirror, or if other circuit elements are interconnected therewith, the total current drained to or sourced from those circuit elements must be negligible relative to the base current in the reference transistor 20. This difference is responsible for the improvement in performance of this circuit over the prior art.

Figure 5:
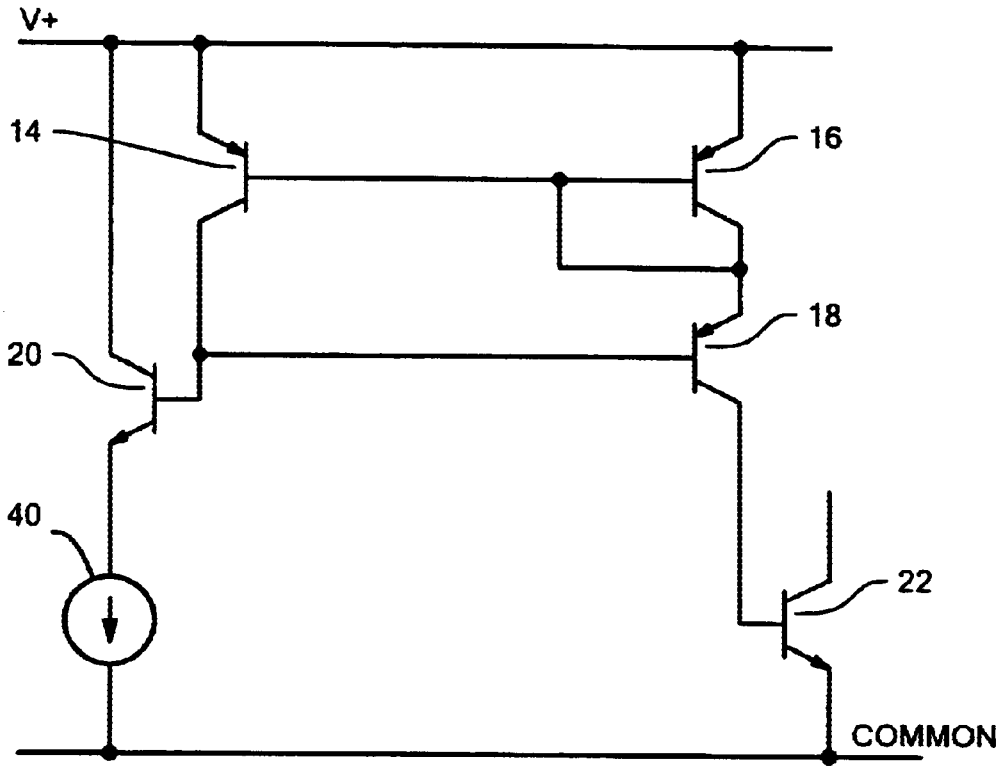
FIG. 5 is a schematic diagram of a prior art current mirror replica bias system in which the reference transistor is not incorporated into the current mirror.

As explained in the following paragraphs, the quality of this de-coupling is a function of the Beta of the reference transistor 20. To illustrate, consider the circuit in FIG. 5 which might be proposed to mirror the base current of the reference transistor, but which is not as good as the present invention because it lacks the de-coupling provided by the present invention. The circuit in FIG. 5 is similar to the circuit in FIG. 4 except that the base of transistor 18 is connected to the base of reference transistor 20 instead of the emitter of reference transistor 20, and thus the interconnection between the base of the reference transistor and the input to the current mirror is not exclusive. The circuit in FIG. 5 comprises current mirror transistors 14 and 16, as well as a third transistor 18, similar to the circuit in FIG. 4. There is a current source 40 connected between the emitter of the reference transistor 20 and the common voltage, which current source performs the same current sourcing function in the circuit in FIG. 5 as resistor 24 performs in the circuit of FIG. 4. Current reference transistor 20 has its base connected to the collector of transistor 14, which is the input to the current mirror. Because the reference transistor 20 of FIG. 5 is not exclusively incorporated into the current mirror, however, the base current from transistor 18 is interconnected with the base current of reference transistor 20 and the collector of transistor 14. Thus, the current being mirrored is the sum of the base current of the reference transistor 20 and the base current of transistor 18, with the result that the effect of the current source 40 on the current mirroring function is diminished directly by the base current of transistor 18, thus causing an error in the output of the current mirror, when compared to the desired output as a replica of the current in current source 40. Further, if the output transistors are scaled-up to amplify the output current, the base current of transistor 18 will be correspondingly larger and will cause further errors in the output.

In contrast to the circuit in FIG. 5, the base of transistor 18 of FIG. 4 is interconnected with the emitter of the reference transistor 20 and resistor 24. Therefore, the base of transistor 20 is exclusively connected to the collector of transistor 14, and the base current of transistor 18 has no direct impact on the base current of reference transistor 20, and therefore has no direct impact on the current being mirrored. Of course, since the base current of transistor 18 does take away from the current in current source resistor 24, the emitter current in the reference transistor is somewhat diminished, and that in turn diminishes the base current of reference transistor 20, leading to some error. However, the base current of the reference transistor is diminished by an amount equal to the base current of transistor 18 divided by Beta of reference transistor 20, with the result that the error is small. If Beta of the reference transistor 20 is sufficiently large, the error will be negligible.

This advantage provided by the present invention will still apply even if transistors 16, 18 and 22 of FIG. 4 are scaled up to produce a multiple of the reference current. Because the base current of the transistors in the output side of the circuit has very little impact on the reference current, this circuit is able to provide an accurate bias current through replication of a reference current, even at high multiplication ratios.

Figure 6:
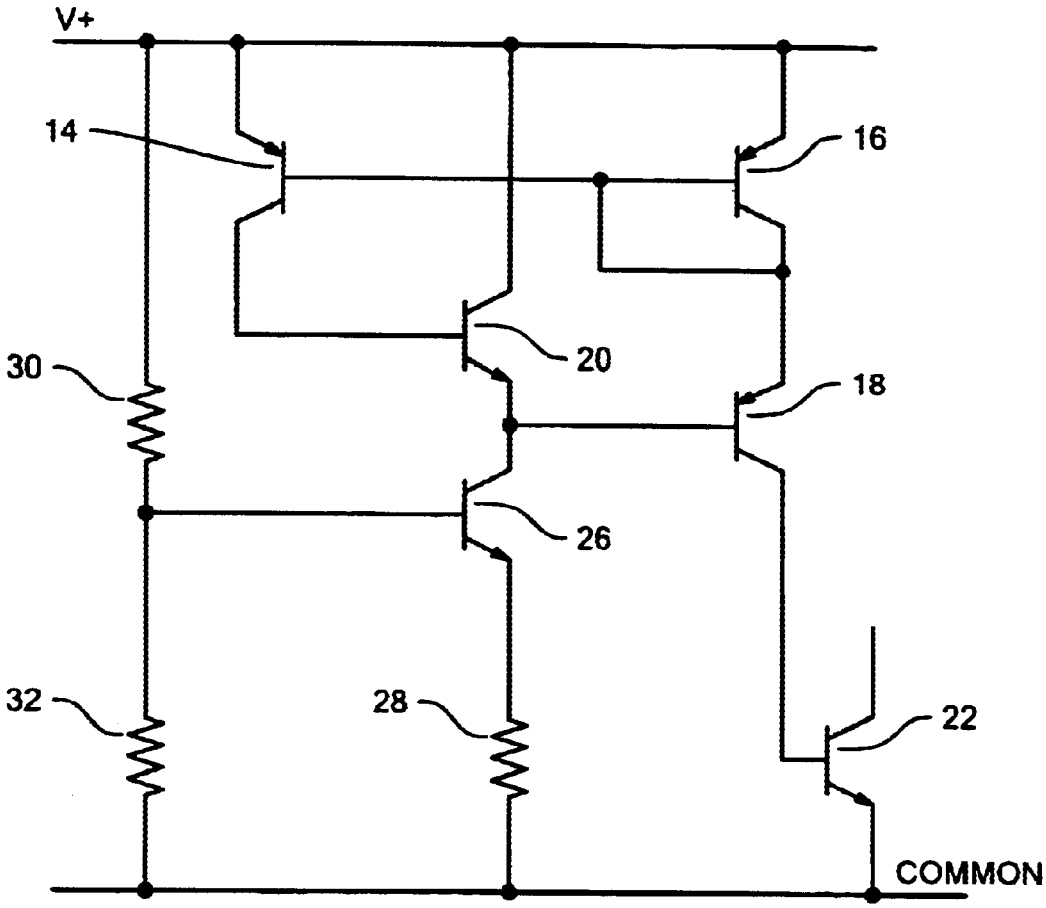
FIG. 6 is a schematic diagram of an alternate and improved embodiment of a current mirror replica bias system according to the present invention similar to the system shown in FIG. 4, showing additional circuitry to make its operation proportional to absolute temperature.

There is shown in FIG. 6 a current mirror replica biasing system according to this invention in which resistor 24 of FIG. 4 has been replaced by transistor 26 of the same polarity as transistor 20, and by resistors 28, 30 and 32.

Resistors 30 and 32 form a voltage divider between the positive voltage supply and the common supply, and serve to bias transistor 26 into its forward active region. Similar to the circuit in FIG. 4, the current flowing through transistors 20 and 26 is then determined by the selection of the value of resistor 28.

If the base of transistor 26 is biased to one band-gap voltage, the current through transistor 26 is proportional to absolute temperature. Since the current flow analysis for the remainder of the circuit in FIG. 6 is the same as for the circuit in FIG. 4, the output at the collector of transistor 22 of the circuit in FIG. 6 is likewise proportional to absolute temperature.

There is shown in FIG. 7 another embodiment of a current mirror replica biasing system according to this invention in which another transistor 34 has been added. The collector of transistor 34 is interconnected with the base of transistor 20 and the collector of transistor 14. The emitter of transistor 34 is connected to the base of transistor 26, and the base of transistor 34 is interconnected to the voltage divider resistors 30 and 32.

The addition of transistor 34 effectively doubles the sample base current used as input to the replicating circuit, while maintaining the user control of the reference current by the selection of the value of resistor 28. Since the replica current flowing into the base of transistor 22 is a function of the collector current of transistor 14, the replica current can be increased by increasing the collector current of transistor 14. In the circuit in FIG. 7, the collector current of transistor 14 now consists exclusively of two base currents—the base current of transistor 20, as well as most of the base current of transistor 26, through transistor 34. Similar to the circuit of FIG. 6, resistors 30 and 32 bias the base of transistor 34. In FIG. 7, however, in order to make circuit performance proportional to absolute temperature, the base of transistor 34 must be biased to twice the band-gap voltage, to accommodate the bias current requirements of both transistors 26 and 34.

Therefore, the circuit in FIG. 7 achieves an additional reference multiplication by the addition of one transistor. This is an improvement over the multiplication method of the circuit in FIG. 4, since it requires the addition of only one small transistor, as opposed to the scaling-up of transistors 16, 18 and 22 of FIG. 4.

There is shown in FIG. 8 a circuit similar to that in FIG. 4, but with an additional resistor 36 shown between the collector of transistor 18 and the base of transistor 22, as might be required, depending on the application of the present invention.

There is shown in FIG. 9 a circuit similar to that in FIG. 4, but with an additional resistor 38 shown between the emitter of transistor 22 and the common supply, as might be required, depending on the application of the present invention.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. A current mirror replica biasing system comprising:

a reference current circuit having a control terminal, for producing a reference current;

a current mirror circuit having an input and an output, the input electrically connected exclusively to the control terminal of the reference current circuit; and an output transistor having a control terminal, the output of the current mirror circuit electrically connected to the control terminal of the output transistor, wherein the output current of the output transistor is a replica of the reference current.

2. A current mirror replica biasing system comprising:

a current mirror circuit including a controlling transistor and a controlled transistor having their emitters connected to like polarity voltages and operating at a predetermined current ratio;

an output buffering transistor of like polarity to the controlling and controlled transistors, said output buffering transistor having one of its load terminals connected to the collector of the controlled transistor and the bases of the controlling transistor and controlled transistor;

a current reference transistor and an output transistor, both of opposite polarity to the controlling, controlled and output buffering transistors, said current reference transistor having its collector connected to a voltage of like polarity to the voltage connected to the emitters of the controlling and controlled transistors, and its base connected to the collector of the controlling transistor, the base of said output transistor connected to the collector of said output buffering transistor, and the collector of said output transistor connected to the circuit to be biased; and a current source for generating a desired current having a first terminal and a second terminal, with the second of said terminals connected to a common voltage closer to ground than the voltages connected to the emitters of the controlling and controlled transistors and the collector of the current reference transistor, and the first of said terminals interconnected to the emitter of the current reference transistor and the base of the output buffering transistor.

3. The current mirror replica biasing system of claim 2 in which said controlled and controlling transistors have equal current densities and the areas of their emitters is in said predetermined current ratio.

4. The current mirror replica biasing system of claim 2 in which said controlled and controlling transistors have their emitters connected to voltages of like polarity but of different magnitude, the difference in voltages defining the ratio of said predetermined current ratios.

5. The current mirror replica biasing system of claim 2 in which said transistors are bipolar transistors, said controlled, controlling and output buffering transistors are PNPs and said current reference and output transistors are NPNs.

6. The current mirror replica biasing system of claim 2 in which said transistors are bipolar transistors, said controlled, controlling and output buffering transistors are NPNs and said current reference and output transistors are PNPs.

7. The current mirror replica biasing system of claim 2 in which said current source is a first resistor.

8. The current mirror replica biasing system of claim 2 in which said current source comprises a first resistor having a first terminal and a second terminal, a sixth transistor of like polarity to said current reference transistor, a second resistor and a third resistor, where the collector of said sixth transistor is interconnected to the emitter of the current reference transistor and the base of the output buffering transistor and the emitter of said sixth transistor is connected to said first terminal of said first resistor, the second terminal of said first resistor connected to said common voltage, and said second resistor and third resistor connected as a voltage divider between said common voltage and said voltage of like polarity to that of the controlling and controlled transistors, and the base of said sixth transistor interconnected with the center of said voltage divider.

9. A current mirror replica biasing system comprising:

a current mirror circuit including a controlling transistor and a controlled transistor having their emitters connected to like polarity voltages and operating at a predetermined current ratio;

an output buffering transistor of like polarity to the controlling and controlled transistors, said output buffering transistor having one of its load terminals connected to the collector of the controlled transistor;

a first resistor having a first and second terminal;

a second resistor having a first and second terminal;

a third resistor having a first and second terminal;

a current reference transistor of opposite polarity to the controlling, controlled and output buffering transistors, having its collector connected to a voltage of like polarity to that of the controlling and controlled transistors and its base connected to the collector of the controlling transistor;

an output transistor of like polarity to the current reference transistor, the emitter of said output transistor being connected to a voltage less than the voltages connected to the controlling, controlled and current reference transistors, and the collector of said output transistor connected to the circuit to be biased;

a sixth transistor, of like polarity to the current reference transistor, the collector of said sixth transistor interconnected to the emitter of said current reference transistor and the base of said output buffering transistor, the emitter of said sixth transistor connected to said first terminal of said first resistor, and the second terminal of said first resistor connected to a voltage less than the voltages connected to the controlling, controlled and current reference transistors;

a seventh transistor of like polarity to the current reference transistor, the emitter of said seventh transistor connected to the base of said sixth transistor, the collector of said seventh transistor interconnected to the base of said current reference transistor and the collector of said controlling transistor, said second a third resistors connected as a voltage divider between a voltage of like polarity to that of the controlling and controlled transistors and a voltage less than such voltages, and the base of said seventh transistor interconnected with an intermediate terminal of said voltage divider.

10. A method of creating a bias current comprising the steps of:

establishing in a reference transistor a reference current of known magnitude;

using a current mirror circuit having an input and an output, the input exclusively directly connected to a base current of the reference transistor, to mirror at the output of the current mirror the base current of the reference transistor to produce a mirrored current; and feeding the mirrored current into the base of an output transistor.

11. A current mirror replica biasing system comprising:

a current mirror circuit including a controlling transistor and a controlled transistor having their emitters connected to voltages of like polarity but of different magnitude and operating at a predetermined current ratio, the difference in voltages defining the ratio of said predetermined current ratios;

an output buffering transistor of like polarity to the controlling and controlled transistors, said output buffering transistor having one of its load terminals connected to the collector of the controlled transistor and the bases of the controlling transistor and controlled transistor;

a current reference transistor and an output transistor, both of opposite polarity to the controlling, controlled and output buffering transistors, said current reference transistor having its collector connected to a voltage of like polarity to the voltage connected to the emitters of the controlling and controlled transistors, and its base connected to the collector of the controlling transistor, the base of said output transistor connected to the collector of said output buffering transistor, and the collector of said output transistor connected to the circuit to be biased; and a current source for generating a desired current having a first terminal and a second terminal, with the second of said terminals connected to a common voltage closer to ground than the voltages connected to the emitters of the controlling and controlled transistors and the collector of the current reference transistor, and the first of said terminals interconnected to the emitter of the current reference transistor and the base of the output buffering transistor.

12. A current mirror replica biasing system comprising:

a current mirror circuit including a controlling transistor and a controlled transistor having their emitters connected to like polarity voltages and operating at a predetermined current ratio;

an output buffering transistor of like polarity to the controlling and controlled transistors, said output buffering transistor having one of its load terminals connected to the collector of the controlled transistor and the bases of the controlling transistor and controlled transistor;

a current reference transistor and an output transistor, both of opposite polarity to the controlling, controlled and output buffering transistors, said current reference transistor having its collector connected to a voltage of like polarity to the voltage connected to the emitters of the controlling and controlled transistors, and its base connected to the collector of the controlling transistor, the base of said output transistor connected to the collector of said output buffering transistor, and the collector of said output transistor connected to the circuit to be biased; and a current source for generating a desired current, the current source comprising a first resistor having a first terminal and a second terminal, a sixth transistor of like polarity to said current reference transistor, a second resistor and a third resistor, where the collector of said sixth transistor is interconnected to the emitter of the current reference transistor and the base of the output buffering transistor and the emitter of said sixth transistor is connected to said first terminal of said first resistor, the second terminal of said first resistor connected to said common voltage, and said second resistor and third resistor connected as a voltage divider between said common voltage and said voltage of like polarity to that of the controlling and controlled transistors, and the base of said sixth transistor interconnected with the center of said voltage divider.

* * * * *

UNITED STATES PATENT AND TRADEMARK OFFICE

CERTIFICATE OF CORRECTION

PATENT NO. : 6,677,807 B1
DATED : January 13, 2004
INVENTOR(S) : Adrian Paul Brokaw It is certified that error appears in the above-identified patent and that said Letters Patent is hereby corrected as shown below:

Drawings,

Fig. 4 and in the same figure shown on the first page of the patent, transistor 20 should be shown as a NPN transistor rather than a PNP transistor and should have its emitter coupled to the base of transistor 18 as correctly shown in Fig. 8.

Signed and Sealed this

Fourth Day of May, 2004

JON W. DUDAS
*Acting Director of the United States Patent and Trademark Office*